US011605491B2

(12) United States Patent
Tsukada

(10) Patent No.: US 11,605,491 B2
(45) Date of Patent: Mar. 14, 2023

(54) CORE MAIN BODY INCLUDING OUTER PERIPHERAL IRON CORE, REACTOR INCLUDING SUCH CORE MAIN BODY AND MANUFACTURING METHOD THEREOF

(71) Applicant: Fanuc Corporation, Yamanashi (JP)

(72) Inventor: Kenichi Tsukada, Tamanashi (JP)

(73) Assignee: Fanuc Corporation, Yamanashi (JP)

( * ) Notice: Subject to any disclaimer, the term of this patent is extended or adjusted under 35 U.S.C. 154(b) by 274 days.

(21) Appl. No.: 16/903,904

(22) Filed: Jun. 17, 2020

(65) Prior Publication Data

US 2020/0402697 A1 Dec. 24, 2020

(30) Foreign Application Priority Data

Jun. 20, 2019 (JP) ..... JP2019-114792

(51) Int. Cl.

| | |
|---|---|
| ***H01F 30/12*** | (2006.01) |
| ***H01F 27/26*** | (2006.01) |
| ***H01F 41/02*** | (2006.01) |
| *H01F 27/30* | (2006.01) |

(52) U.S. Cl.

CPC ..... *H01F 27/263* (2013.01); *H01F 41/0206* (2013.01); *H01F 27/30* (2013.01)

(58) Field of Classification Search

CPC ..... H01F 27/263
USPC ..... 336/212
See application file for complete search history.

(56) References Cited

U.S. PATENT DOCUMENTS

| | | | | |
|---|---|---|---|---|
| 3,626,345 | A * | 12/1971 | Funaki | H03H 7/0184 336/233 |
| 5,331,536 | A * | 7/1994 | Lane | H01F 27/40 336/183 |
| 10,629,360 | B2 | 4/2020 | Shirouzu et al. | |
| 2018/0068776 | A1* | 3/2018 | Maeda | H01F 27/266 |

FOREIGN PATENT DOCUMENTS

| | | | |
|---|---|---|---|
| JP | 2017079222 | A | 4/2017 |
| JP | 2017098426 | A | 6/2017 |
| JP | 2018198303 | A | 12/2018 |
| JP | 2019016690 | A | 1/2019 |
| JP | 2019029449 | A | 2/2019 |

OTHER PUBLICATIONS

Japanese Notice of Reasons for Refusal for Japanese Application No. 2019-114792, dated Jan. 24, 2023 with translation, 5 pages.

* cited by examiner

*Primary Examiner* — Ronald Hinson
(74) *Attorney, Agent, or Firm* — RatnerPrestia

(57) ABSTRACT

A core main body includes: an outer peripheral iron core, and at least three iron cores coupled to an inner surface of the outer peripheral iron core, in which a gap is formed between adjacent iron cores among the at least three iron cores, the gap being magnetically connectable, and a plurality of notches are formed on an outer circumferential surface of the outer peripheral iron core, the plurality of notches extending in an axial direction of the outer peripheral iron core. The reactor includes such a core body.

7 Claims, 10 Drawing Sheets

CORE MAIN BODY INCLUDING OUTER PERIPHERAL IRON CORE, REACTOR INCLUDING SUCH CORE MAIN BODY AND MANUFACTURING METHOD THEREOF

CROSS-REFERENCE TO RELATED APPLICATIONS

This application is a new U.S. Patent Application that claims benefit of Japanese Patent Application No. 2019-114792, dated Jun. 20, 2019, the disclosure of this application is being incorporated herein by reference in its entirety for all purposes.

BACKGROUND OF THE INVENTION

1. Field of the Invention

The present invention relates to a core main body including an outer peripheral iron core, a reactor including such a core main body and a manufacturing method thereof.

2. Description of the Related Art

In recent years, a reactor has been developed that includes a core main body including an outer peripheral iron core and a plurality of iron cores disposed inside the outer peripheral iron core. Each of the plurality of iron cores has a coil wound therearound.

When the core main body is installed, the core main body is disposed between two iron core anchoring parts, for example, an end plate and/or a pedestal, and metal bolts are respectively inserted into a plurality of through-holes formed in the two iron core anchoring parts and the outer peripheral iron core to anchor the core main body (e.g., see JP 2019-029449 A).

SUMMARY OF THE INVENTION

However, contacting of the metal bolt with the inner wall of the through-hole, i.e., the outer peripheral iron core generates a large loop current, and a problem of increased loss arises as a result. Insulating the metal bolts makes it possible to avoid this problem, but leads to increase in cost.

In a case where the through-holes in the outer peripheral iron core are eliminated and the metal bolts are arranged outside the outer peripheral iron core, the loss does not increase. However, in this case, another issue arises in that the iron core anchoring part increases in size, resulting in a larger reactor. Furthermore, reducing the weight of the core main body and the reactor is a constant problem in the technical field.

Therefore, there is a desire to provide a lightweight core main body that can be produced at low cost without increasing loss and without increasing size, a reactor including such a core main body and a manufacturing method thereof.

According to a first aspect of the present disclosure, there is provided a reactor including: a core main body, the core main body including an outer peripheral iron core, and at least three iron cores and coils coupled to an inner surface of the outer peripheral iron core, the at least three iron core coils including at least three iron cores and coils respectively wound around the iron cores, the at least three iron cores respectively having radial inner end portions positioned near a center of the outer peripheral iron core, converging toward the center of the outer peripheral iron core, a gap being formed between one iron core of the at least three iron cores and another iron core adjacent to the one iron core, the gap being magnetically connectable, the radial inner end portions of the at least three iron cores being spaced apart from each other with the gap being magnetically connectable, a plurality of notches being formed on an outer circumferential surface of the outer peripheral iron core, the plurality of notches extending in an axial direction of the outer peripheral iron core, the reactor further including: two iron core anchoring parts respectively arranged on both end faces of the outer peripheral iron core; and a plurality of bolts passing through the plurality of notches and configured to anchor the core main body by sandwiching between the two iron core anchoring parts.

In the first aspect, since the bolts pass through the notches formed on the outer peripheral iron core, the bolts are disposed inside the footprint of the core main body, and it is thus possible to avoid increase in size of the reactor. Additionally, the material cost of the outer peripheral iron core is reduced, which leads to reduction in cost. Furthermore, since a plurality of notches are formed on the outer peripheral iron core, the reactor can be reduced also in weight.

The objects, features and advantages of the present invention will become more apparent from the description of the following embodiments in conjunction with the accompanying drawings.

DETAILED DESCRIPTION

Figure 1A:
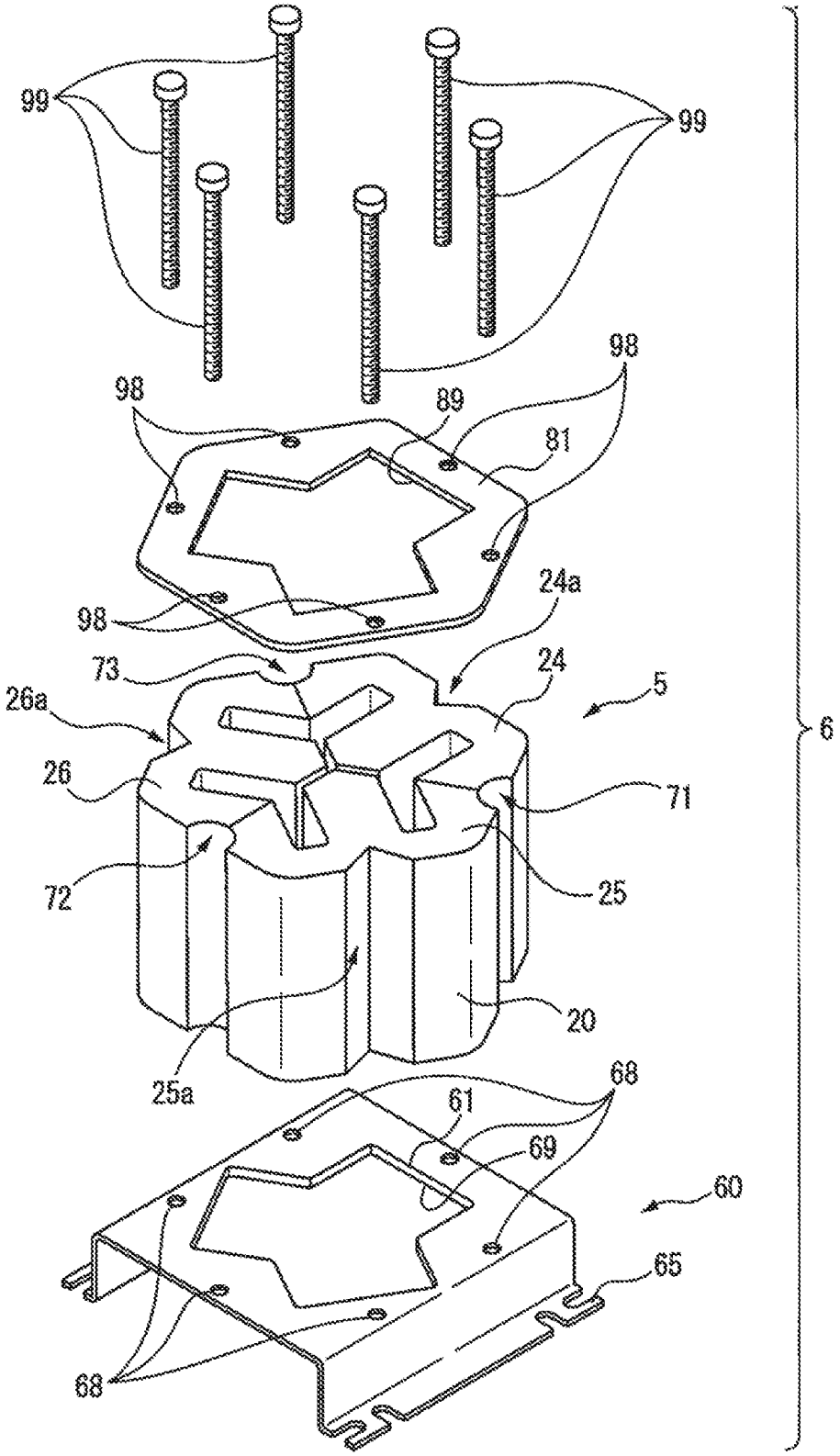
FIG. 1A is an exploded perspective view of a reactor according to a first embodiment.

Embodiments of the present invention will be described below with reference to the accompanying drawings. Throughout the drawings, corresponding components are denoted by common reference numerals.

While in the following description, the three phase reactors are primarily described by way of example, an application of the present disclosure is not limited to a three-phase reactor and the present disclosure is widely applicable to a multi-phase reactor in which a constant inductance is required for each phase. In addition, the reactor according to the present disclosure is not limited to that provided on a primary side and a secondary side of an inverter in an industrial robot or a machine tool and can be applied to various apparatuses.

Figure 1B:
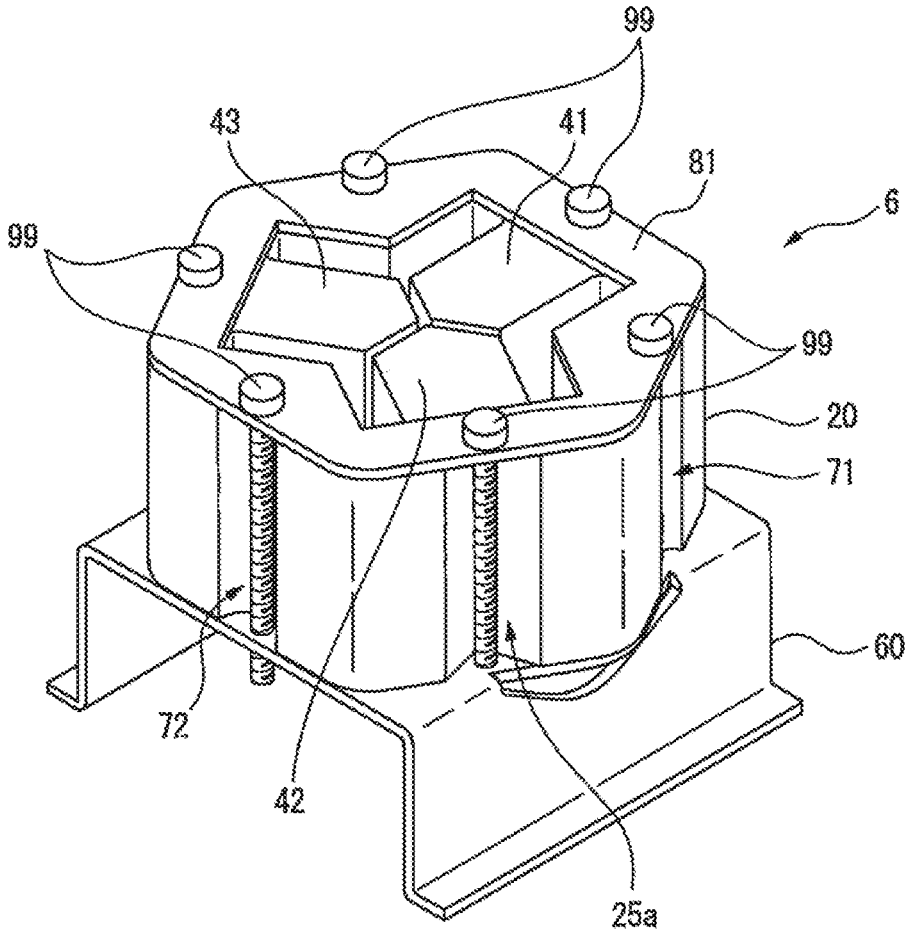
FIG. 1B is a perspective view of the reactor illustrated in FIG. 1A.

FIG. 1A is an exploded perspective view of a reactor according to a first embodiment, and FIG. 1B is a perspective view of the reactor illustrated in FIG. 1A. A reactor 6 illustrated in FIG. 1A and FIG. 1B mainly includes a core main body 5, two iron core anchoring parts 60 and 81 that sandwich the core main body 5 therebetween in an axial direction of the core main body 5 for fastening, and an anchoring part, for example, a bolt 99, that fastens these iron core anchoring parts to each other. In the following description, the two iron core anchoring parts 60 and 81 are an end plate 81 and a pedestal 60, respectively, but iron core anchoring parts of other forms that can sandwich and fasten the core main body 5 in the axial direction may be used. The end plate 81 is, across the entire edge portion of an end face of an outer peripheral iron core 20, which will be described later, of the core main body 5, in contact with the outer peripheral iron core 20.

The end plate 81 and the pedestal 60 are preferably formed from a non-magnetic material, for example, aluminum, SUS, resin, or the like. In the pedestal 60, an opening 69 having an outer shape suitable for placing the end face of the core main body 5 is formed. The end plate 81 has an outer shape that partially corresponds to the end face of the outer peripheral iron core 20, and an opening 89 formed in the end plate 81 has a shape that substantially corresponds to the inner circumferential surface of the outer peripheral iron core 20. The opening 69 formed in the pedestal 60 and the opening 89 formed in the end plate 81 are assumed to be sufficiently large for coils 51 to 53 (described later) to protrude from the end face of the core main body 5. Additionally, the height of the pedestal 60 is assumed to be slightly larger than the protruding height of the coils 51 to 53 protruding from the end face of the core main body 5. A notch 65 formed on a bottom race of the pedestal 60 is used to anchor the reactor 6 provided on the pedestal 60 to a predetermined location. Furthermore, a plurality of through-holes 98 are formed at equal intervals in the end plate 81, and a plurality of through-holes 68 are also formed in a top face of the pedestal 60 at positions corresponding to the through-holes 98.

Figure 2:
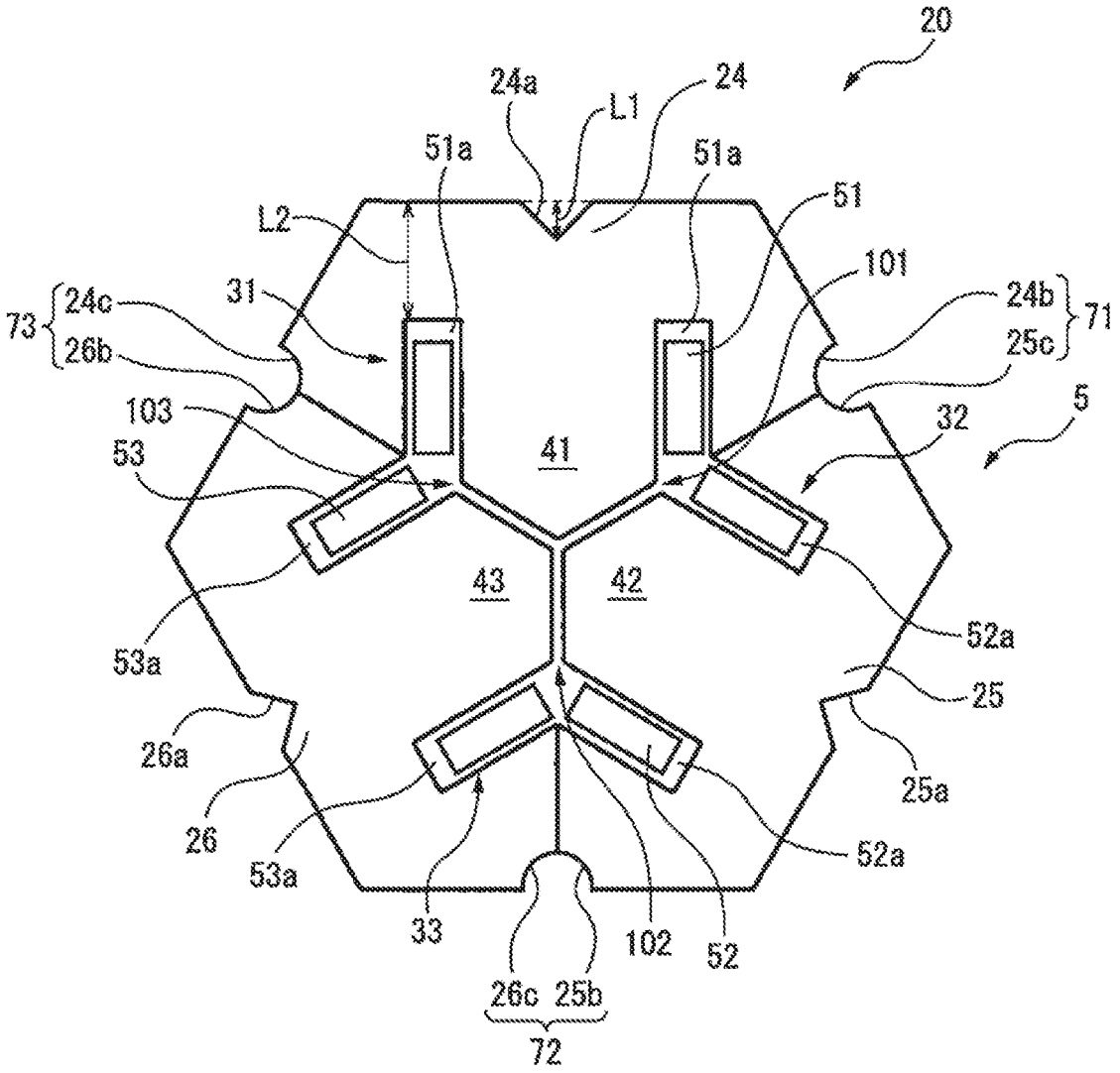
FIG. 2 is a cross-sectional view of a core main body included in the reactor according to the first embodiment.

FIG. 2 is a cross-sectional view of the core main body included in the reactor according to the first embodiment. As illustrated in FIG. 2, the core main body 5 includes the outer peripheral iron core 20 and three iron core coils 31 to 33 that mutually magnetically connecting to the outer peripheral iron core 20. In FIG. 2, the iron core coils 31 to 33 are disposed inside the outer peripheral iron core 20. These iron core coils 31 to 33 are arranged at equal intervals in a circumferential direction of the core main body 5. Note that the outer peripheral iron core 20 may have a shape similar to a circular shape or other substantially even-sided regular polygon. Additionally, the number of iron core coils preferably is a multiple of three, and with this, the reactor 6 can be used as a three-phase reactor.

As can be seen from the drawing, the iron core coils 31 to 33 respectively includes iron cores 41 to 43 extending only radially in the outer peripheral iron core 20; and the coils 51 to 53 wound around the corresponding iron cores. The iron cores 41 to 43 is surrounded by the outer peripheral iron core 20. The iron cores 41 to 43 each have a radial outer end portion in contact with the outer peripheral iron core 20 or formed integrally with the outer peripheral iron core 20. Note that in some drawings, the illustration of the coils 51 to 53 is eliminated for the sake of simplicity.

In FIG. 2, the outer peripheral iron core 20 is composed of a plurality of outer peripheral iron core portions, e.g., three outer peripheral iron core portions 24 to 26 divided in the circumferential direction at equal intervals. The outer peripheral iron core portions 24 to 26 are formed integrally with the iron cores 41 to 43, respectively. Forming the outer peripheral iron core 20 with the plurality of outer peripheral iron core portions 24 to 26 as described above enables, even when the outer peripheral iron core 20 is large, the outer peripheral iron core 20 described above to be easily manufactured.

In addition, each of the radial inner end portions of the iron cores 41 to 43 is positioned near the center of the outer peripheral iron core 20. In the drawing, the radial inner end portion of each of the iron cores 41 to 43 converges toward the center of the outer peripheral iron core 20 and has a tip angle of about 120 degrees. The radial inner end portions of the iron cores 41 to 43 are spaced apart from each other with gaps 101 to 103 being magnetically connectable.

In other words, the radial inner end portion of the iron core 41 is spaced apart from the radial inner end portions of the respective two adjacent iron cores 42 and 43 with the gaps 101 and 102. The same applies to the other iron cores 42 and 43. The gaps 101 to 103 are equal to each other in dimension.

As described above, the present invention does not require a center iron core positioned at the center of the core main body 5, so the core main body 5 can be reduced in weight and formed easily. In addition, the three iron core coils 31 to 33 are surrounded by the outer peripheral iron core 20, so magnetic fields generated from the coils 51 to 53 do not leak from the outer peripheral iron core 20 to the outside. The gaps 101 to 103 can be provided at any thickness and at a low cost, so it is advantageous in design compared to reactors with configurations in the related art.

In addition, the core main body 5 according to the present invention has a difference in magnetic path length between phases that is less than that in reactors with configurations in the related art. Thus, the present invention enables reducing inductance unbalance due to the difference in magnetic path length.

Incidentally, as can be seen from FIG. 1A, FIG. 1B, and FIG. 2, notches 24*a* to 24*c*, 25*a* to 25*c*, and 26*a* to 26*c* are formed on the outer circumferential surfaces of the outer peripheral iron core portions 24 to 26, respectively. The notches 24*a*, 25*a*, and 26*a* are formed in the centers of the corresponding outer circumferential surfaces of the outer peripheral iron core portions 24 to 26. In other words, the notches 24*a*, 25*a*, and 26*a* are formed at outer end portion corresponding positions on the outer circumferential surface of the outer peripheral iron core 20 corresponding to respective radial outer end portions 41*a* to 43*a* of the iron cores 41 to 43. The cross section of each of the notches 24*a*, 25*a*, and 26*a* in the axial direction of the core main body 5 is substantially triangular, but may have another shape.

Furthermore, on the outer circumferential surface of the outer peripheral iron core portion 24, the notches 24*b* and 24*c* are further formed. The notches 24*b* and 24*c* are each formed at a coupling surface corresponding position corresponding to a coupling surface where the outer peripheral iron core portion 24 is coupled to each of the outer peripheral iron core portions 25 and 26. In the outer peripheral iron core portions 25 and 26 as well, in the same manner, the notches 25*b* and 25*c* and the notches 26*b* and 26*c* are respectively formed.

As illustrated in FIG. 2, the notch 24*b* of the outer peripheral iron core portion 24 and the notch 25*c* of the outer peripheral iron core portion 25 adjacent to each other form together a common notch 71. Similarly, the notches 25*b* and 26*c* adjacent to each other form a common notch 72, and the notches 26*b* and 24*c* adjacent to each other form a common notch 73. The cross section of the common notches 71 to 73 in the axial direction of the core main body 5 is semicircular, but may have another shape, and the notches 24*a*, 25*a*, and 26*a* and the common notches 71 to 73 may have the same shape.

After the coils 51 to 53 are wound around the iron cores 41 to 43, respectively, the outer peripheral iron core portions 24 to 26 are assembled with each other to manufacture the outer peripheral iron core 20. As can be seen with reference to FIG. 1A, the one end of the outer peripheral iron core 20 in which the coils 51 to 53 are respectively wound around the iron cores 41 to 43 is placed on the pedestal 60, and the end plate 81 is arranged on the other end of the core main body 5. Then, when the plurality of bolts 99 are inserted into the through-holes 98 of the end plate 81, the shaft portions of the plurality of bolts 99 respectively pass through the notches 24*a* to 26*a* and the common notches 71 to 73. The tips of the plurality of bolts 99 are screwed into the through-holes 68 of the pedestal 60. As a result, the outer peripheral iron core 20 can be firmly anchored between the end plate 81 and the pedestal 60. To this end, threads may be formed on the inner circumferential surfaces of the through-holes 68 and/or the through-holes 89.

As described above, in the first embodiment of the present invention, since the bolts 99 pass through the notches 24*a* to 26*a* and the common notches 71 to 73 formed on the outer peripheral iron core 20, the bolts 99 are disposed inside the footprint of the core main body 5, and it is thus possible to avoid increase in size of the reactor 6. Additionally, the material cost of the outer peripheral iron core 20 is reduced, which leads to reduction in cost. Furthermore, since the plurality of notches 24*a* to 26*a* and the common notches 71 to 73 are formed on the outer peripheral iron core 20, the reactor 6 can be reduced also in weight. Note that only one group of the notches 24*a* to 26*a* and the common notches 71 to 73 may be formed, and in this case, similar effects can be achieved with a simple configuration.

Incidentally, FIG. 3A to FIG. 3F are diagrams each illustrating a magnetic flux density of a reactor in which the notches are not formed. FIG. 4A is a diagram illustrating a relationship between a phase and a current, and FIG. 4B is an end face view of the outer peripheral iron core. In FIG. 4A, the iron cores 41 to 43 of the reactor 6 are set to the R-phase, the S-phase, and the T-phase, respectively. In FIG. 4A, a current in the R-phase is indicated by the dotted line, a current in the S-phase is indicated by the solid line, and a current in the T-phase is indicated by the broken line.

Figure 3A:
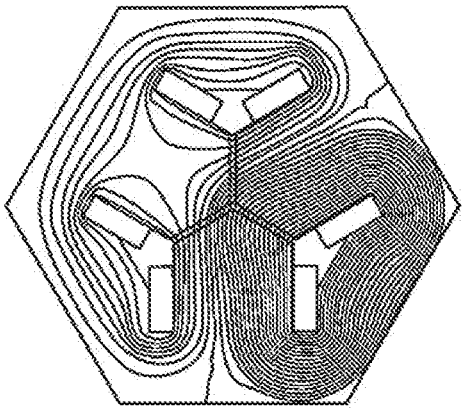
FIG. 3A is a first diagram illustrating a magnetic flux density of the reactor.
Figure 3B:
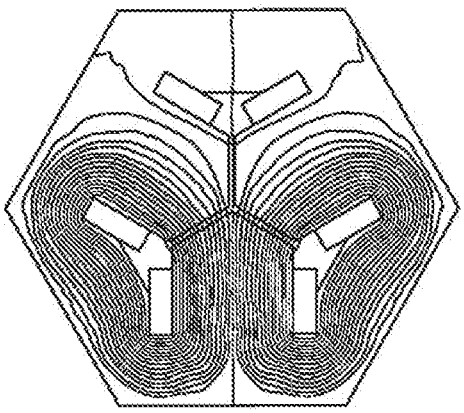
FIG. 3B is a second diagram illustrating a magnetic flux density of the reactor.
Figure 3C:
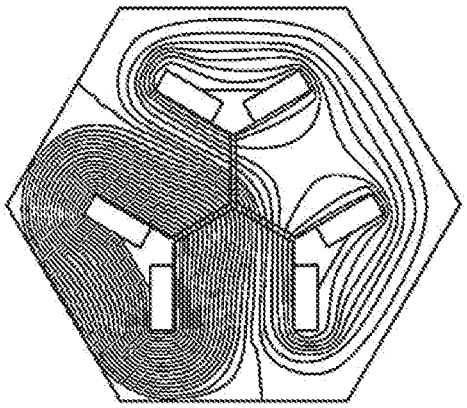
FIG. 3C is a third diagram illustrating a magnetic flux density of the reactor.
Figure 3D:
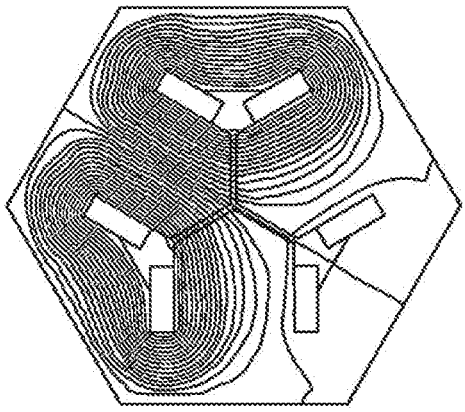
FIG. 3D is a fourth diagram illustrating a magnetic flux density of the reactor.
Figure 3E:
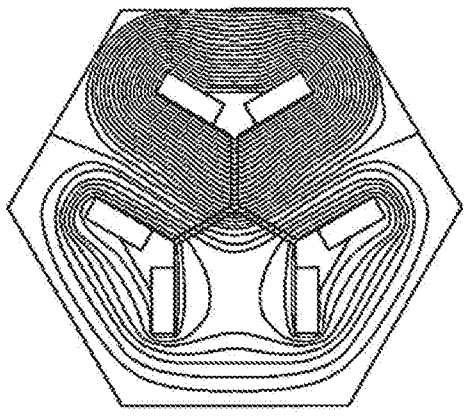
FIG. 3E is a fifth diagram illustrating a magnetic flux density of the reactor.
Figure 3F:
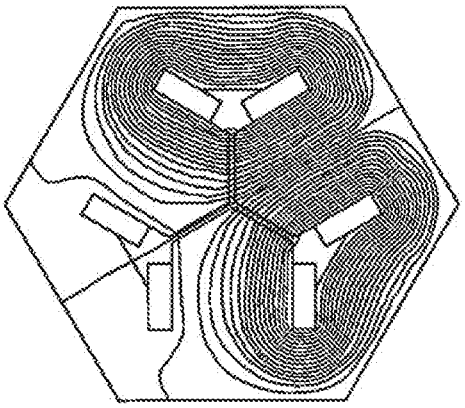
FIG. 3F is a sixth diagram illustrating a magnetic flux density of the reactor.
Figure 4A:
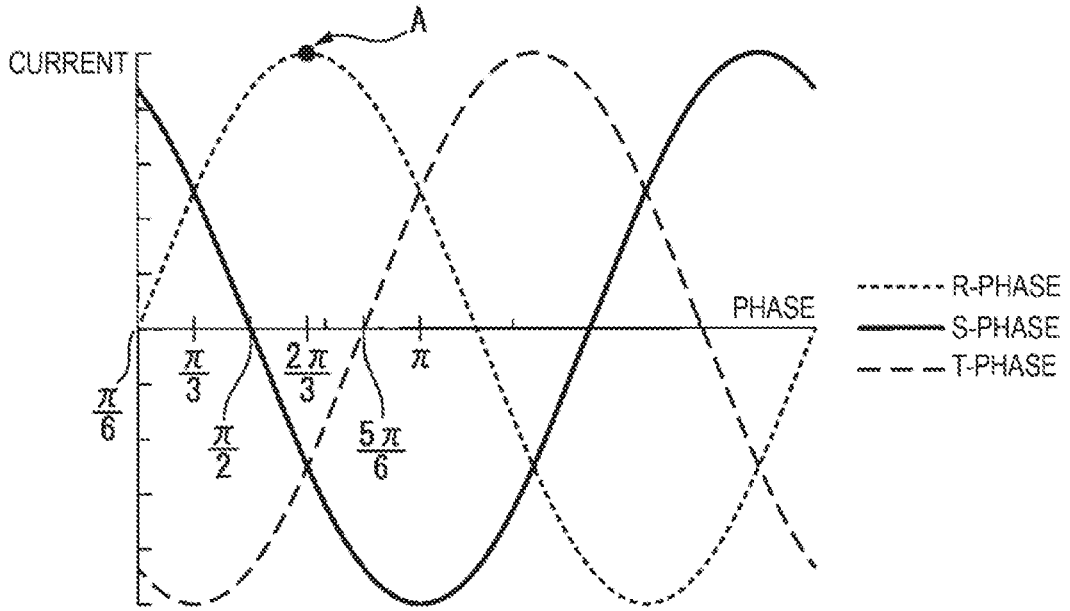
FIG. 4A is a diagram illustrating a relationship between a phase and a current.
Figure 4B:
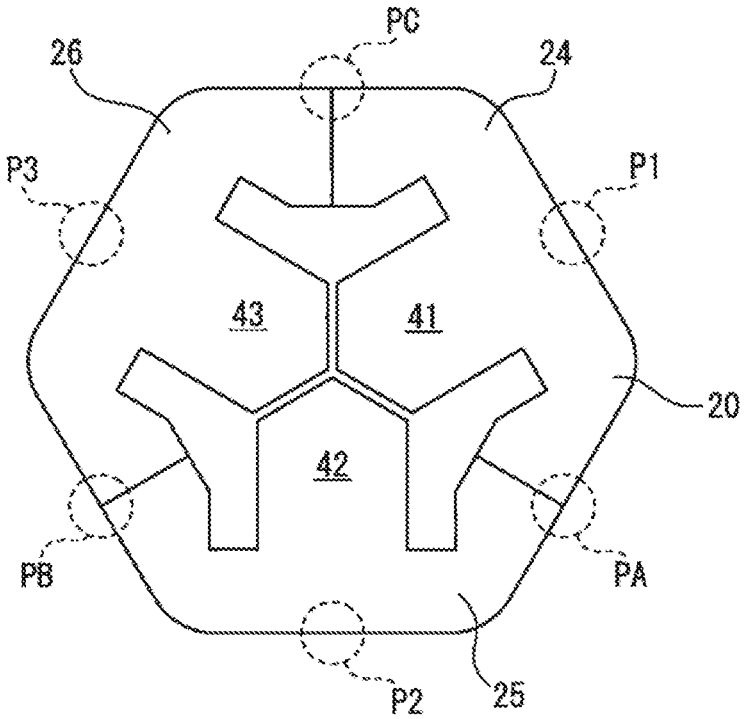
FIG. 4B is an end face view of an outer peripheral iron core.

When an electrical angle is $\pi/6$ in FIG. 4A, the magnetic flux density illustrated in FIG. 3A is obtained. In the same manner, when the electrical angle is $\pi/3$, the magnetic flux density illustrated in FIG. 3B is obtained, when the electrical angle is $\pi/2$, the magnetic flux density illustrated in FIG. 3C is obtained, when the electrical angle is $2\pi/3$, the magnetic flux density illustrated in FIG. 3D is obtained, when the electrical angle is $5\pi/6$, the magnetic flux density illustrated in FIG. 3E is obtained, and when the electrical angle is $\pi$, the magnetic flux density illustrated in FIG. 3F is obtained.

As can be seen with reference to FIGS. 3A to 3F and FIG. 2, the magnetic flux densities of outer end portion corresponding positions P1 to P3 (corresponding to the positions of the notches 24*a* to 26*a*) on the outer circumferential surface of the outer peripheral iron core 20 respectively corresponding to the radial outer end portions 41*a* to 43*a* of the iron cores 41 to 43 are less than the magnetic flux density of the remaining part of the outer peripheral iron core 20. The reason for this is that the magnetic flux is difficult to pass through the outer end portion corresponding positions P2 to P3. In the same manner, the magnetic flux densities of coupling surface corresponding positions PA to PC (corresponding to the positions of the common notches 71 to 73) corresponding to the coupling surfaces of the outer peripheral iron core portions 24 to 26 adjacent to each other are less than the magnetic flux density of the remaining part of the outer peripheral iron core 20. Accordingly, it is preferable to form the notches 24*a* to 26*a* and the common notches 71 to 73 at the outer end portion corresponding positions P1 to P3 and the coupling surface corresponding positions PA to PC, respectively. In such a case, the effects described above can be achieved while suppressing effects on the magnetic properties of the reactor 5. Furthermore, the same applies to a case in which one group of the notches 24*a* to 26*a* and the common notches 71 to 73 is formed.

Figure 5A:
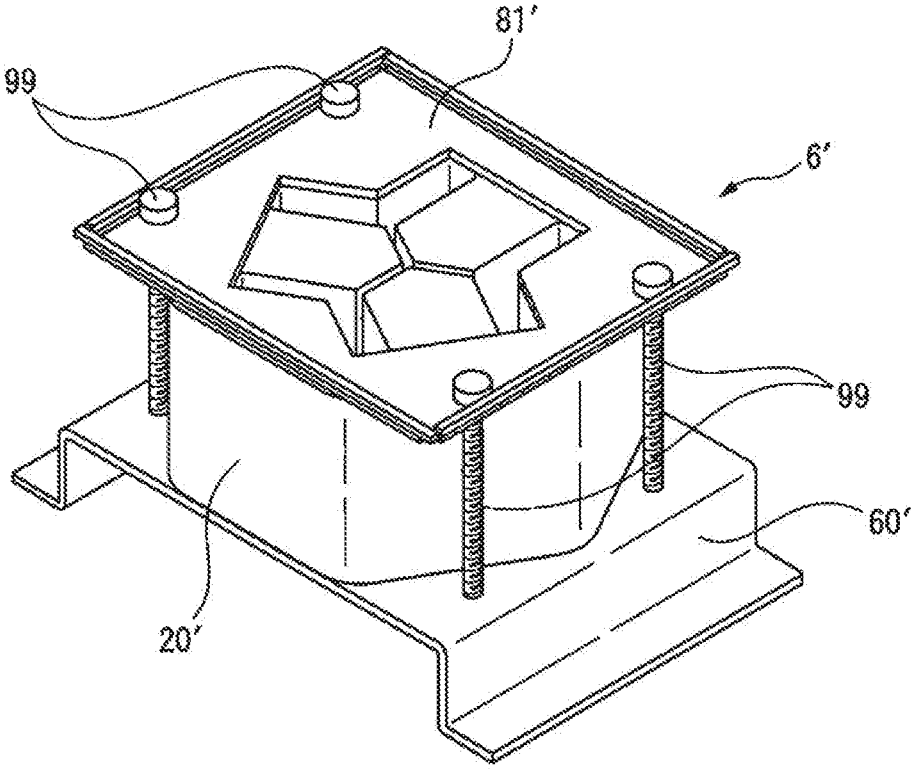
FIG. 5A is a perspective view of a first reactor in the related art.

FIG. 5A is a perspective view of a first reactor in the related art. On an outer peripheral iron core 20' of a reactor 6' illustrated in FIG. 5A, the notches 24*a* to 26*a* and the common notches 71 to 73 are not formed. The same applies to reactors respectively illustrated in FIGS. 5B to 5D. In FIG. 5A, since the plurality of bolts 99 are arranged outside the outer peripheral iron core 20, the end plate 81 is large enough to receive the plurality of bolts 99. Accordingly, the reactor 6' illustrated in FIG. 5A is made to be larger than the reactor 6 illustrated in FIG. 1B.

Figure 5B:
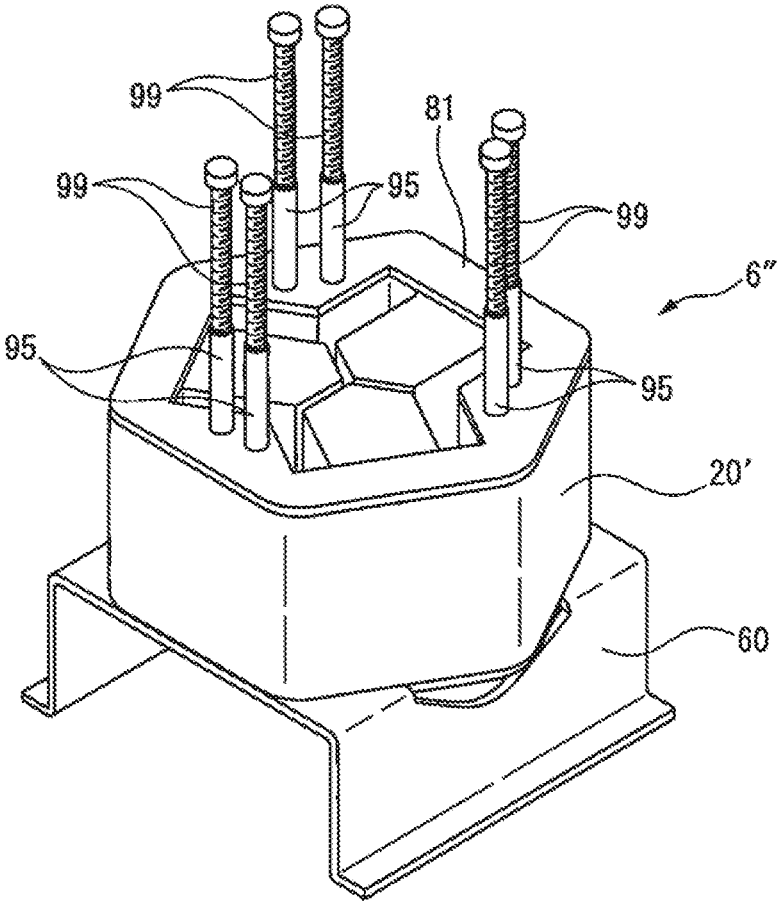
FIG. 5B is a perspective view of a second reactor in the related art.

FIG. 5B is a per view of a second reactor in the related art. The shaft portions of the plurality of bolts 99 are each surrounded by an insulator, for example, an insulating tube 95. The plurality of bolts 99 are inserted into through-holes formed in the outer peripheral iron core 20'. In this case, the insulator is required separately, resulting in increased manufacturing cost of a reactor 6'.

In contrast, in the present invention, since the bolts 99 are arranged inside the footprint of the core main body 5 as described above, it is possible to avoid increase in size of the reactor 6. Additionally, the positions of the bolts 99 illustrated in FIG. 1B are closer to the center of the core main body 5 than the positions of the bolts 99 illustrated in FIG. 5A. Therefore, in the present invention, the core main body 5 can be more firmly fixed between the end plate 81 and the pedestal 60. Furthermore, there is no need to separately prepare the insulator (insulating tube 95), and the material cost of the outer peripheral iron core 20 is reduced by an amount corresponding to the notches 24*a* to 26*a* and the common notches 71 to 73, and thus the reactor 6 can be manufactured at low cost.

Figure 5C:
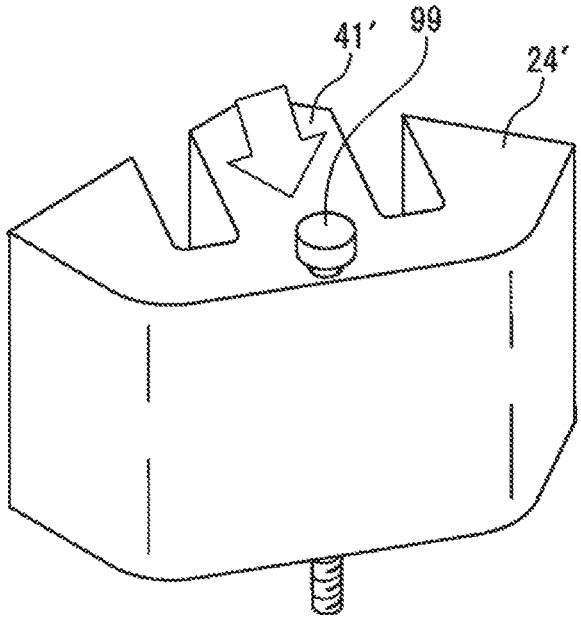
FIG. 5C is a partial perspective view of another reactor in the related art.
Figure 5D:
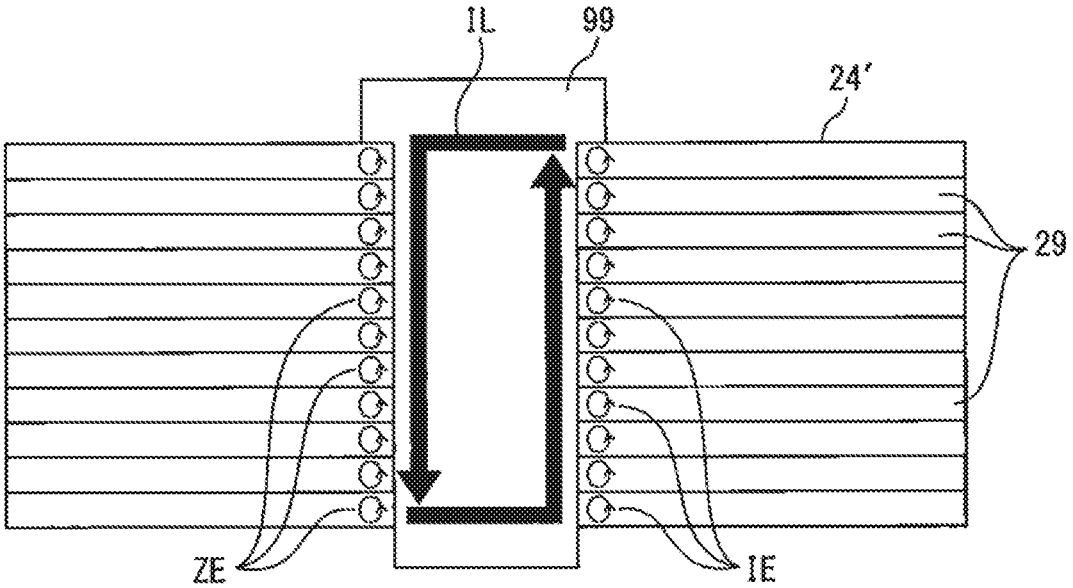
FIG. 5D is a partial cross-sectional view of the other reactor illustrated in FIG. 5C.

In this regards, FIG. 5C is a partial perspective view of another reactor in the related art, and FIG. 5D is a partial cross-sectional view of the other reactor illustrated in FIG. 5C. In FIG. 5C, the bolt 99 is inserted into a through-hole formed in an outer peripheral iron core portion 24'. As illustrated in FIG. 5C and FIG. 5D, the outer peripheral iron core portion 24' and an iron core 41' are each formed by stacking a plurality of magnetic plates, for example, steel plates, carbon steel plates, or electromagnetic steel plates or are formed of a dust core. In this point, the same applies to the outer peripheral iron core portions 24 to 26 of the present invention.

When energizing the reactor illustrated in FIG. 5C, a magnetic flux acts in the arrow direction in FIG. 5C. As a result, as illustrated in FIG. 5D, small loop eddy currents IE are generated in each of a plurality of magnetic plates 29. Since the bolt 99 and the outer peripheral iron core portion 24 are in contact with each other, a large loop current IL is generated by these eddy currents IE, so that loss occurs.

In the present invention, a radial direction distance L1 from the outer circumferential surface of the outer peripheral iron core 20 to the farthest portion of each of the notches 24*a*, 25*a*, and 26*a* and the common notches 71 to 73 is greater than a diameter of the shaft portion of the bolt 99. Therefore, the bolt 99 is prevented from coming into contact with the outer peripheral iron core 20, as a result, a large loop current is not generated, and it is possible to avoid increase in loss. Additionally, since the bolt 99 of the present invention may be a bolt made of a magnetic material, for example, a normal metal bolt, it is not necessary to perform an insulating process on the bolt 99, and the reactor 6 can be produced at a lower cost.

Note that, as illustrated in FIG. 2, the radial direction distance L1 of each of the notches 24*a* to 26*a* is preferably less than or equal to half a width L2 of the outer peripheral iron core 20. The reason for this is because, as illustrated in FIG. 4A, for example, when the current of the R-phase is at the apex A, the currents of the S-phase and T-phase are minus, and their magnitude is half the magnitude of the current of R-phase at the apex A. Therefore, if the radial direction distance L1 is less than or equal to half the width L2 of the outer peripheral iron core 20, the magnetic properties of the reactor 6 are maintained and also do not affect the strength of the outer peripheral iron core 20. Note that this is also applied to the common notches 71 to 73.

Figure 6:
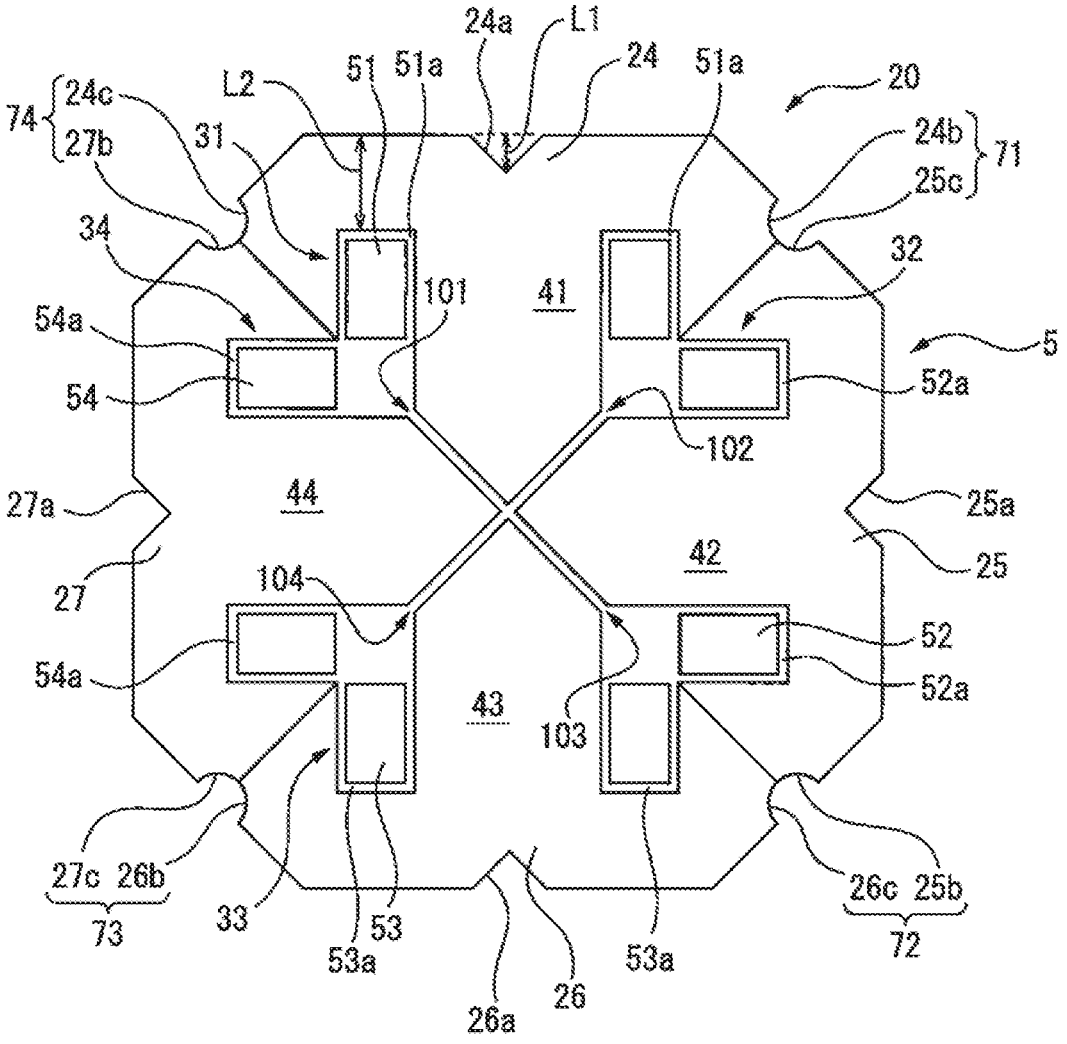
FIG. 6 is a cross-sectional view of a core main body included in a reactor according to a second embodiment.

FIG. 6 is a cross-sectional view of a core main body included in a reactor according to a second embodiment. The core main body 5 illustrated in FIG. 6 includes the outer peripheral iron core 20 having a cross section of a substantially octagonal shape and four iron core coils 31 to 34, similar to those described above, disposed inside the outer peripheral iron core 20. These iron core coils 31 to 34 are arranged at equal intervals in a circumferential direction of the core main body 5. In addition, the number of iron cores is preferably an even number of four or more, and thus the reactor provided with the core main body 5 can be used as a single-phase reactor.

As can be seen from the drawings, the outer peripheral iron core 20 is formed of four outer peripheral iron core portions 24 to 27 that are circumferentially divided. The iron core coils 31 to 34 respectively include iron cores 41 to 44 extending only in the radial direction and coils 51 to 54 wound around the corresponding iron cores. The iron cores 41 to 44 each have a radial outer end portion formed integrally with the corresponding outer peripheral iron core portions 24 to 27. The number of the iron cores 41 to 44 and the number of the outer peripheral iron core portions 24 to 27 may not be necessarily equal to each other. The same applies to the core main body 5 illustrated in FIG. 2.

In addition, the iron cores 41 to 44 each have a radial inner end portion positioned near the center of the outer peripheral iron core 20. In FIG. 6, the radial inner end portion of each of the iron cores 41 to 44 converges toward the center of the outer peripheral iron core 20 and has a tip angle of about 90 degrees. The radial inner end portions of the iron cores 41 to 44 are spaced apart from each other with gaps 101 to 104 being magnetically connectable.

In the same manner as the configuration described above, notches 24*a*, 25*a*, 26*a*, and 27*a* are respectively formed in the centers of the corresponding outer circumferential surfaces of the outer peripheral iron core portions 24 to 27. Furthermore, the notches 24*b* and 24*c* are formed at coupling surface corresponding positions corresponding to coupling surfaces where the outer peripheral iron core portion 24 is coupled to the outer peripheral iron core portions 25 and 27. In the outer peripheral iron core portions 25, 26, and 27 as well, in the same manner, the notches 25*b* and 25*c*, the notches 26*b* and 26*c*, and notches 27*b* and 27*c* are respectively formed. In the same manner as described above, the notches 24*b* and 25*c* adjacent to each other form the common notch 71, the notches 25*b* and 26*c* adjacent to each other form the common notch 72, the notches 26*b* and 27*c* adjacent to each other form the common notch 73, and the notches 27*b* and 24*c* adjacent to each other form a common notch 74. Note that the radial direction distance L1 of each of the notches 24*a* to 27*a* is less than or equal to half the width L2 of the outer peripheral iron core 20. This is also applied to the common notches 71 to 74.

In the second embodiment, in accordance with the outer shape of the outer peripheral iron core 20, the shapes of the end plate 81 and the pedestal 60 are also assumed to vary. In the same manner as in the first embodiment, one end of the core main body 5 in which the coils 51 to 54 are wound around the iron cores 41 to 44, respectively, is placed on the pedestal 60, and the end plate 81 is arranged on the other end of the core main body 5. Then, when the plurality of bolts 99 are inserted into the through-holes 98 of the end plate 81, the shaft portions of the plurality of bolts 99 pass through the insides of the notches 24*a* to 27*a* and the common notches 71 to 74, respectively. The tips of the plurality of bolts 99 are screwed into the through-holes 68 of the pedestal 60. As a result, the core main body 5 can be firmly anchored between the end plate 81 and the pedestal 60. Therefore, it will be apparent that similar effects as those described above are also obtained in the embodiment illustrated in FIG. 6.

Note that even the core main body 5 from which the coils 51 to 53 (54) is eliminated illustrated in FIG. 2 and FIG. 6 is included in the scope of the present invention. In this case, at least one group of the notches 24*a* to 26*a* (27*a*) and the common notches 71 to 73 (74) is formed on the outer circumferential surface of the outer peripheral iron core 20. Accordingly, it will be understood that the material cost of the outer peripheral iron core 20 is reduced, which leads to reduction in cost, and the weight of the core main body 5 can be reduced.

Aspects of the Disclosure

According to a first aspect, there is provided a reactor including: a core main body, the core main body including an outer peripheral iron core, and at least three iron cores and coils coupled to an inner surface of the outer peripheral iron core, the at least three iron core coils including at least three iron cores and coils respectively wound around the iron cores, the at least three iron cores respectively having radial inner end portions positioned near a center of the outer peripheral iron core, converging toward the center of the outer peripheral iron core, a gap being formed between one iron core of the at least three iron cores and another iron core adjacent to the one iron core, the gap being magnetically connectable, the radial inner end portions of the at least three iron cores being spaced apart from each other with the gap being magnetically connectable, a plurality of notches being formed on an outer circumferential surface of the outer peripheral iron core, the plurality of notches extending in an axial direction of the outer peripheral iron core, the reactor further including: two iron core anchoring parts respectively arranged on both end faces of the outer peripheral iron core; and a plurality of bolts passing through the plurality of notches and configured to anchor the core main body by sandwiching between the two iron core anchoring parts.

According to a second aspect, the first aspect is configured such that the plurality of bolts are formed of a magnetic material.

According to a third aspect, the first or second aspect is configured such that the outer peripheral iron core includes a plurality of outer peripheral iron core portions, and the at least three iron cores is respectively coupled to the plurality of outer peripheral iron core portions.

According to a fourth aspect, the third aspect is configured such that the plurality of notches are formed on at least one of an outer end portion corresponding position on the outer circumferential surface of the outer peripheral iron core corresponding to a radial outer end portion of each of the at least three iron cores, and a coupling surface corresponding position corresponding to a coupling surface of outer peripheral iron core portions adjacent to each other among the plurality of outer peripheral iron core portions.

According to a fifth aspect, any one of the first to fourth aspects is configured such that the number of the at least three iron core coils is a multiple of three.

According to a sixth aspect, any one of the first to fourth aspects is configured such that the number of the at least three iron core coils is an even number of four or more.

According to a seventh aspect, there is provided a core main body including: an outer peripheral iron core, and at least three iron cores coupled to an inner surface of the outer peripheral iron core, in which the at least three iron cores respectively have radial inner end portions positioned near a center of the outer peripheral iron core, converging toward the center of the outer peripheral iron core, a gap is formed between one iron core of the at least three iron cores and another iron core adjacent to the one iron core, the gap being magnetically connectable, the radial inner end portions of the at least three iron. cores are spaced apart from each other with the gap being magnetically connectable, and a plurality of notches are formed on an outer circumferential surface of the outer peripheral iron core, the plurality of notches extending in an axial direction of the outer peripheral iron core.

According to an eighth aspect, the seventh aspect is configured such that the outer peripheral iron core includes a plurality of outer peripheral iron core portions, and the at least three iron cores is respectively coupled to the plurality of outer peripheral iron core portions.

According to a ninth aspect, the eighth aspect is configured such that the plurality of notches are formed on at least one of an outer end portion corresponding position on the outer circumferential surface of the outer peripheral iron core corresponding to a radial outer end portion of each of the at least three iron cores, and a coupling surface corresponding position corresponding to a coupling surface of outer peripheral iron core portions adjacent to each other among the plurality of outer peripheral iron core portions.

According to a tenth aspect, there is provided a manufacturing method for a reactor, the manufacturing method including: preparing a core main body, the core main body including an outer peripheral iron core, and at least three iron cores and coils coupled to an inner surface of the outer peripheral iron core, the at least three iron core coils including at least three iron cores and coils respectively wound around the iron cores, the at least three iron cores respectively having radial inner end portions positioned near a center of the outer peripheral iron core, converging toward the center of the outer peripheral iron core, a gap being formed between one iron core of the at least three iron cores and another iron core adjacent to the one iron core, the gap being magnetically connectable, the radial inner end portions of the at least three iron cores being spaced apart from each other with the gap being magnetically connectable, a plurality of notches being formed on an outer circumferential surface of the outer peripheral iron core, the plurality of notches extending in an axial direction of the outer peripheral iron core, the manufacturing method for the reactor further including: arranging two iron core anchoring parts on both end faces of the outer peripheral iron core, respectively; and causing a plurality of bolts to pass through the plurality of notches and anchoring the core main body by sandwiching between the two iron core anchoring parts.

Effects of Aspects

In the first and tenth aspects, since the bolts pass through the notches formed on the outer peripheral iron core, the bolts are disposed inside the footprint of the core main body, and it is thus possible to avoid increase in size of the reactor. Additionally, the material cost of the outer peripheral iron core is reduced, which leads to reduction in cost. Furthermore, since the plurality of notches are formed on the outer peripheral iron core, the reactor can be reduced also in weight.

In the second aspect, since a bolt made of a magnetic material, for example, a normal metal bolt can be used, it is not necessary to perform an insulating process on the bolt, and the reactor can be produced at a low cost. Furthermore, since the bolt made of the magnetic material passing through the notch does not make contact with the outer peripheral iron core, the problem of increasing loss can be avoided.

In the third aspect, even when the outer peripheral iron core is large, manufacturing can be performed with ease.

In the fourth aspect, the notch can be formed without affecting the magnetic properties of the reactor.

In the fifth aspect, the reactor can be used as a three-phase reactor.

In the sixth aspect, the reactor can be used as a single-phase reactor.

In the seventh aspect, since the plurality of notches are formed on the outer peripheral iron core, the material cost of the outer peripheral iron core is reduced, which leads to reduction in cost, and the weight of the core main body can also be reduced.

In the eighth aspect, even when the outer peripheral iron core is large, manufacturing can be performed with ease.

In the ninth aspect, the notch can be formed without affecting the magnetic properties of the reactor.

While the invention has been described with reference to specific embodiments, it will be understood, by those skilled in the art, that various changes or modifications may be made thereto without departing from the scope of the claims described later.

The invention claimed is:

1. A reactor comprising:

a core main body, wherein the core main body including an outer peripheral iron core including a plurality of outer peripheral iron core portions, and at least three iron cores and coils coupled to an inner surface of the outer peripheral iron core, the at least three iron core coils including at least three iron cores and coils respectively wound around the iron cores, the at least three iron cores respectively having radial inner end portions positioned near a center of the outer peripheral iron core, converging toward the center of the outer peripheral iron core, a gap being formed between one iron core of the at least three iron cores and another iron core adjacent to the one iron core, the gap being magnetically connectable, the radial inner end portions of the at least three iron cores being spaced apart from each other with the gap being magnetically connectable, a plurality of notches being formed on an outer circumferential surface of the outer peripheral iron core, the plurality of notches extending in an axial direction of the outer peripheral iron core, wherein the plurality of notches are formed on at least one of an outer end portion corresponding position on the outer circumferential surface of the outer peripheral iron core corresponding to a radial outer end portion of each of the at least three iron cores, and a coupling surface corresponding position corresponding to a coupling surface of outer peripheral iron core portions adjacent to each other among the plurality of outer peripheral iron core portions, the reactor further comprising:

two iron core anchoring parts respectively arranged on both end faces of the outer peripheral iron core; and a plurality of bolts passing through the plurality of notches and configured to anchor the core main body by sandwiching between the two iron core anchoring parts.

2. The reactor of claim 1, wherein the plurality of bolts are formed of a magnetic material.

3. The reactor of claim 1, wherein the at least three iron cores is respectively coupled to the plurality of outer peripheral iron core portions.

4. The reactor of claim 1, wherein the number of the at least three iron core coils is a multiple of three.

5. The reactor of claim 1, wherein the number of the at least three iron core coils is an even number of four or more.

6. A core main body comprising:

an outer peripheral iron core including a plurality of outer peripheral iron core portions, and at least three iron cores coupled to an inner surface of the outer peripheral iron core, wherein the at least three iron cores respectively have radial inner end portions positioned near a center of the outer peripheral iron core, converging toward the center of the outer peripheral iron core, a gap is formed between one iron core of the at least three iron cores and another iron core adjacent to the one iron core, the gap being magnetically connectable, the radial inner end portions of the at least three iron cores are spaced apart from each other with the gap being magnetically connectable, and a plurality of notches are formed on an outer circumferential surface of the outer peripheral iron core, the plurality of notches extending in an axial direction of the outer peripheral iron core, wherein the plurality of notches are formed on at least one of an outer end portion corresponding position on the outer circumferential surface of the outer peripheral iron core corresponding to a radial outer end portion of each of the at least three iron cores, and a coupling surface corresponding position corresponding to a coupling surface of outer peripheral iron core portions adjacent to each other among the plurality of outer peripheral iron core portions.

7. The core main body of claim 6, wherein the at least three iron cores are respectively coupled to the plurality of outer peripheral iron core portions.

* * * * *